United States Patent [19]

Carli

[11] 3,971,312

[45] July 27, 1976

[54] ADJUSTABLE SQUEEGEE HOLDING DEVICE FOR SILKSCREEN PRINTING FRAME

[76] Inventor: Othmar Carli, 341 Baltimore St., Gettysburg, Pa. 17325

[22] Filed: May 19, 1975

[21] Appl. No.: 578,663

[52] U.S. Cl. ..... 101/114; 101/128.1

[51] Int. Cl.[2] ..... B41F 15/02; B41F 15/36

[58] Field of Search ..... 101/114, 115, 123, 126, 101/129, 127.1, 128.1; 118/504

[56] References Cited

UNITED STATES PATENTS

| | | | |
|---|---|---|---|
| 1,910,353 | 5/1933 | Murray et al. | 101/126 |
| 2,210,474 | 8/1940 | Tillett | 101/126 |
| 2,747,501 | 5/1956 | Latimer | 101/114 |
| 2,881,698 | 4/1959 | Graham | 101/123 |
| 3,462,789 | 8/1969 | Seal | 118/504 |

*Primary Examiner*—E. H. Eickholt
*Assistant Examiner*—R. E. Suter
*Attorney, Agent, or Firm*—C. Hercus Just; Samuel M. Learned, Jr.

[57] ABSTRACT

An adjustable squeegee holding device for a silkscreen printing frame, which when installed upon the rear frame member of a silkscreen printing frame provides a convenient place to support and retain an inked squeegee when the same is not in use during silkscreen printing operations as well as additionally providing a silkscreen printing frame counterbalance means when the frame is in a raised position.

7 Claims, 6 Drawing Figures

ADJUSTABLE SQUEEGEE HOLDING DEVICE FOR SILKSCREEN PRINTING FRAME

BACKGROUND OF THE INVENTION

The present invention relates to a counterbalance device for a silkscreen printing frame, which device incorporates the additional feature of having a squeegee holding member affixed thereto, wherein said device is designed primarily for employment upon a manually operated silkscreen printing apparatus as distinquished from an automatic or semi-automatic silkscreen printing apparatus such as taught in U.S. Pat. No. 3,166,011 to LANDESMAN dated Jan. 19, 1965, wherein the latter types of silkscreen printing apparatus normally provide integral counterbalance means and mechanical means to support and manipulate the squeegee member thereof. Generally speaking, the type of silkscreen printing apparatus to which the present invention is adapted to be applied is exemplified by that as illustrated in U.S. Pat. No. 1,533,700 to DIBBLE et al dated Apr. 14, 1925.

One of the operational problems encountered in operating a manual silkscreen printing apparatus is that of having a convenient place to position and support an inked squeegee blade when the same is not in use during squeegee operations to spread ink upon the silkscreen. A traditional expedient has been to prop the squeegee against the rear silkscreen frame member which is directly or indirectly hinged to the printing bed of said appartus, which is that frame member farthest from the operator, while the operator uses one hand to raise the printing frame and support said frame in a pivotally elevated position and the other hand is used to remove a print from the bed of said appartus and reposition and register a blank piece of stock upon said bed to "pull" the next print. The frame is then pivotally lowered into printing position, and by use of the squeegee with either one or both hands, the operator distributes the ink within the limits of the frame upon the screen and pulls the next print. By way of such a repetitive cycle the print run is completed.

In employing the aforementioned expedient method for accommodating an inked squeegee when not in use during printing operations, it frequently happens that, as said printing frame is pivotally raised, and both of the operator's hands are otherwise occupied, the squeegee will also pivot about the rear frame member against which it is supported and either becomes deposited within the frame upon the inked screen, or, falls out of the screen upon the supporting work table or floor, neither of which conditions is acceptable and consequently causes otherwise unnecessary spoilage and waste, and increases the printing time by requiring clean-up before resuming printing operations.

One development known in the art which has facilitated the ease and convenience by which manual silkscreen printing operations may be carried out is that of using a counterbalance, which is normally affixed to the rear of the frame member and is operable to balance the frame when the same is in the pivotally raised position, thereby freeing one of the operator's hands for accomplishing other functions as previously described.

Although the present invention incorporates an adjustable counterbalance structure as a component assembly thereof, as will hereinafter be more specifically detailed and pointed out, said present invention further incorporates and provides features and new and useful advantages, applications, and improvements in the art of manually operated silkscreen printing not heretofore known.

SUMMARY OF THE INVENTION

It is the principal object of the present invention to provide an adjustable squeegee holding device for a silkscreen printing frame, the use of which device will enable the counterbalancing of a silk-screen printing frame in a convenient open position when said printing frame is pivotally raised to remove a silkscreen print and locate a new piece of stock sheet for printing, as well as providing a squeegee holding member as a component thereof, which squeegee holding member additionally serves as a counterweight as well as further providing a convenient means to support an inked squeegee during manual print removal and stock feeding operations while said printing frame is in the open position, thereby improving overall printing cycle operations and procedure and reducing printing cycle time.

It is another object to provide an adjustable squeegee holding counterbalance device for a silkscreen printing frame which incorporates an adjustable squeegee retaining bracket member in order to retain and support squeegees having different handle and/or squeegee blade dimensions.

A further object of the present invention is to provide an adjustable squeegee holding and counterbalance device for a silkscreen printing frame which also incorporates an adjustable counterbalancing weight in order to compensate for the moment effect of different sizes and weights of squeegees when supported in said squeegee holding member and thereby adjustably accomplish counterbalancing of said printing frame when the same is pivotally raised to the open position.

An additional object of the present invention is to provide an adjustable squeegee holding counterbalance device for a silkscreen printing frame which further incorporates an angular positioning rod that is employed to adjust the outward angular declination of the central support shaft of said device, and thereby provide an additional means for adjustably accomplising counterbalancing of said printing frame when the same is pivotally raised to the open position.

It is still a further object of the present invention to provide an adjustable squeegee holding counterbalance device for a silkscreen printing frame wherein a disposable covering of absorbent material is employed to line the squeegee supporting surface of said squeegee holding member, thereby preventing dripping of ink therefrom when said device is operationally employed during silkscreen printing and said squeegee holding member cyclically supports an inked squeegee.

It is still another object of the present invention to provide an adjustable squeegee holding counterbalance device for a silkscreen printing frame, which device is simply removed from the printing frame mounting bracket thereof, for cleaning and wash-up, by pulling pintles from attachment gudeons at the respective bases of the central support shaft and the angular positioning rod.

Yet another object of the present invention is to provide an adjustable squeegee holding and counterbalance device for a silkscreen printing frame which is easily installed upon a silkscreen printing frame by employing conventional tools by one not possessed of a particularly high degree of mechanical aptitude or skill.

Details of the foregoing objects and of the invention, as well as other objects thereof, are set forth in the following specification and illustrated in the accompanying drawings comprising a part thereof.

DETAILED DESCRIPTION

Figure 1:
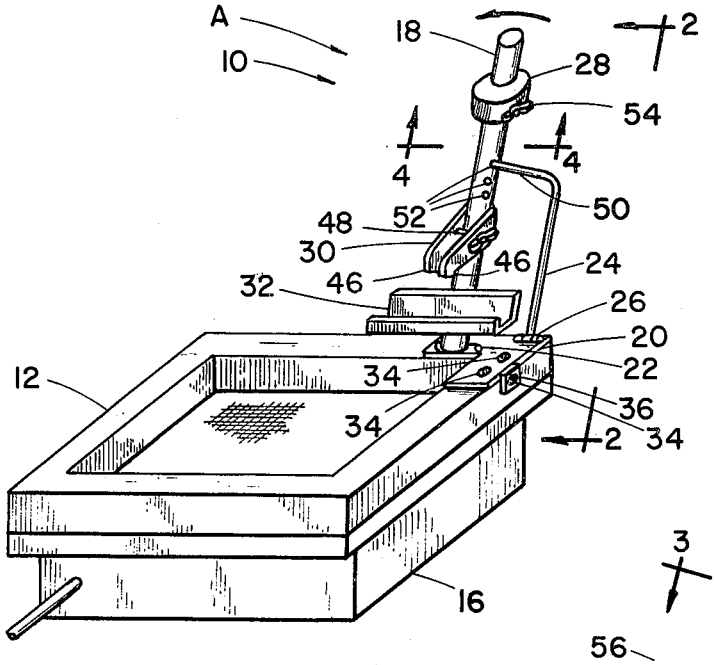
FIG. 1 is a front perspective elevation of an exemplary vacuum base silkscreen printing frame with an adjustable squeegee holding and counterbalance device embodying the principles of the present invention.
Figure 2:
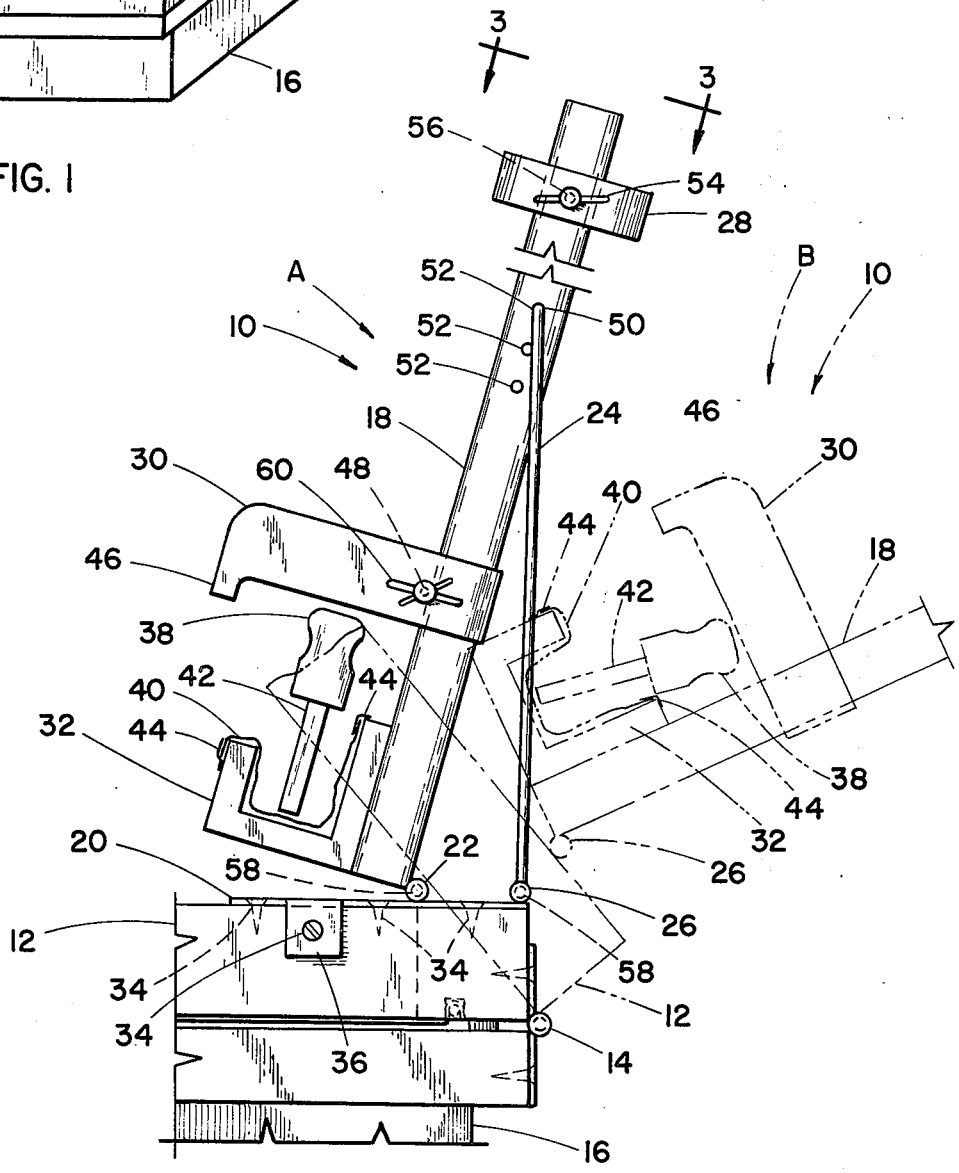
FIG. 2 is an enlarged side elevation of the adjustable squeegee holding and counterbalance device shown in FIG. 1, as seen along the line 2—2 thereof, wherein there is additionally shown a fragmentary phantom view of said device in the printing frame counterbalance position.

Referring to FIG. 1, the present invention is shown therein to comprise an adjustable squeegee holding and counterbalance device 10 for a silkscreen printing frame 12 which is illustrated as being hingedly affixed by base connecting hinge members 14, not shown in FIG. 1 but seen in FIG. 2 and certain of other subsequent Figures, to an exemplary vacuum base 16, said adjustable squeegee holding counterbalance device 10 including as major components thereof a tubular shaft 18 pivotally connected to printing frame mounting bracket 20 by means of hinge 22, a pivotally assembled tubular shaft angular positioning rod 24 which is likewise connected to said printing frame mounting bracket 20 by means of hinge 26, and slidably assembled upon said tubular shaft 18 is an adjustable counterbalance weight 28 and an adjustable squeegee retaining bracket member 30, as well as having fixedly attached to said tubular shaft 18 a squeegee holding member 32.

The view shown in FIG. 2 more particularly illustrates the adaptation of the present invention 10 to a silkscreen printing frame 12, showing said frame 12 in the closed printing position A, and in phantom in the open frame counterbalanced position B. The printing frame mounting bracket 20 is preferably affixed to the silkscreen printing frame 12 by means of screws 34, although any other suitable securing means such as nails or the like may similarly be employed, and the depending mounting bracket support leg 36 is shown affixed to the side of a silkscreen printing frame member 12 by means of another screw 34 to provide additional screen frame support for the means comprising the invention.

As can be seen in FIG. 2, an exemplary squeegee 38 is preferably supportably positioned in the manner illustrated within the channel of said squeegee holding member 32 when said squeegee 38 is not in use during printing operations. Also shown is a disposable absorbent lining material 40, such as paper towel stock or the like, which retains ink from the blade 42 of the squeegee when the same is positioned within the channel of said squeegee holding member during printing operations, thereby preventing dripping of ink from the open ends of said squeegee holding member during printing operations and also facilitating clean-up of the apparatus comprising this invention at the end of a print run. As more clearly illustrated in FIG. 6, said disposable absorbent lining material is detachably secured to said squeegee holding member 32 by means of tape strips 44.

Referring again to FIG. 2 in order to accommodate squeegees 38 of a different vertical dimensions within holding member 32, the adjustable squeegee retaining bracket member 30 may be adjusted in elevation along the tubular shaft 18, and once adjusted to accommodate an exemplary squeegee 38, so that the elevation of the depending ears 46 of said bracket member 30 will manually admit an exemplary squeegee 38 for positioning support within said channel of said squeegee holding member 32, and at the same time prevent the inadvertent removal of the same therefrom, then said retaining bracket member 30 is clamped upon said tubular shaft by means of the bracket member wing bolt 48.

Two means are provided to be employed in combination for accomplishing counterbalancing of the silkscreen printing frame 12 in the open, counterbalanced position B. The initial counterbalance adjustment is set by engaging the outer bent end 50 of the positioning rod 24 in an appropriate opening 52 in the tubular shaft 18 so that the counterbalance moment effect of the exemplary squeegee 38 may be generally compensated for by means of angular positioning of said tubular shaft 18. Secondly, the adjustable counterbalance weight 28 is slidably located at an appropriate elevated position upon tubular shaft 18 to generally provide an open counterbalanced position B for the silkscreen printing frame as illustrated in phantom in FIG. 2, and then said counterbalance weight 28 is locked in said position upon said tubular shaft 18 by means of wing bolt 54 which engages tubular shaft 18 through threaded opening 56 in said counterbalance weight 28.

Figure 3:
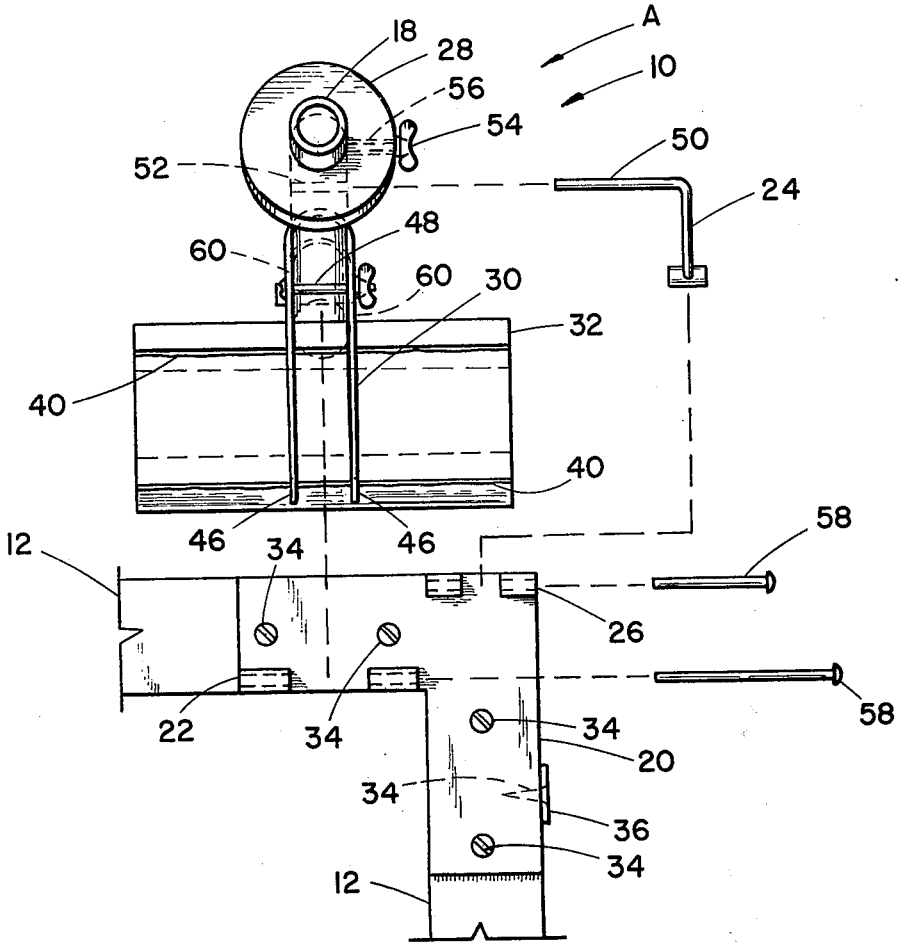
FIG. 3 is an exploded top plan view of an adjustable squeegee holding counterbalance device shown in FIG. 2, as seen along the line 3—3 thereof.

The view shown in FIG. 3 illustrates the disassembly features of the present invention 10, wherein the slidable removal of pintles 58 respectively from the gudgeons of the hinges 22 and 26 detaches the device from its mounting bracket 20 so that said device may be more easily and readily cleaned.

Figure 4:
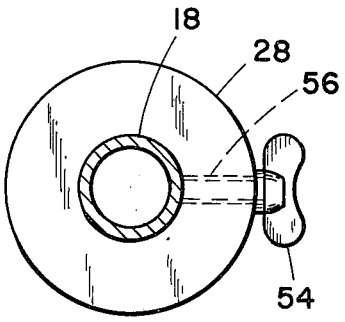
FIG. 4 is an enlarged bottom plan view of the adjustable counterbalance weight of said device as seen along the line 4—4 of FIG. 1.

In FIG. 4 an enlarged bottom plan view of the adjustable counterbalance weight 28 is shown locked to the tubular shaft 18 by means of the wing bolt 54 communicating through threaded opening 56 to clampingly engage said shaft 18.

Figure 5:
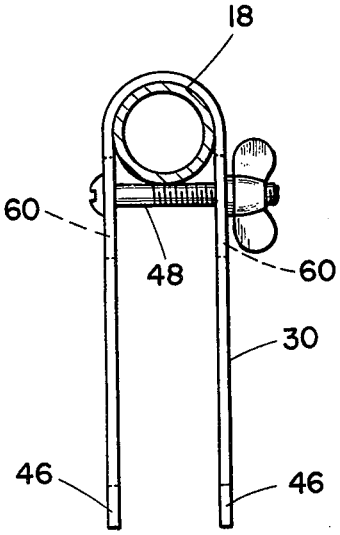
FIG. 5 is an enlarged top plan view of the adjustable squeegee retaining bracket member of the present invention.

In FIG. 5 an enlarged top plan view of the adjustable squeegee retaining bracket member 30 is shown securely clamped to the tubular shaft 18 by means of wing bolt 48 which extends through slotted openings 60 in the respective sides of said bracket member 30 and clamps the same to said shaft 18 securely.

Figure 6:
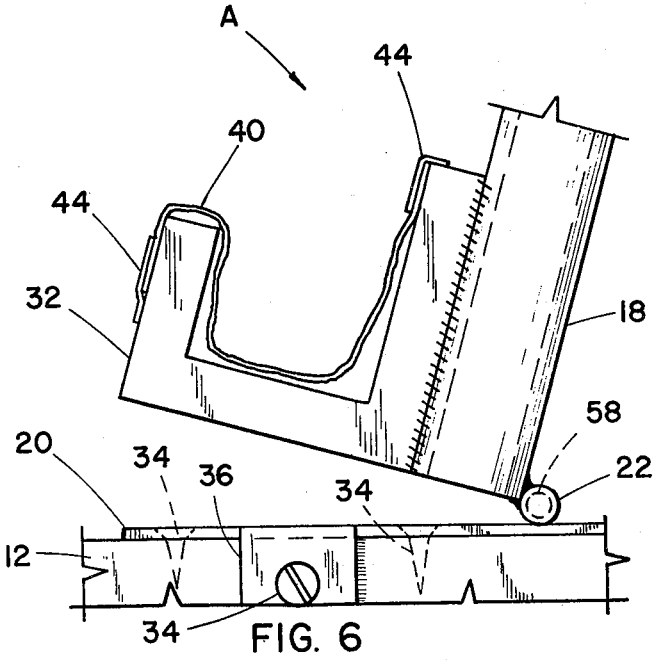
FIG. 6 is a fragmentary enlarged side elevation of the squeegee holding member of the present invention.

In FIG. 6 an enlarged side elevation of the squeegee holding section of the device 10 is shown, wherein there is particularly illustrated the squeegee holding member 32 and the means for locating the disposable absorbent lining material 40 in the channel thereof, as well as the detachable means for affixing said lining material 40 to the squeegee holding member 32 by means of tape 44.

The adjustable squeegee holding counterbalance device 10 as illustrated and heretofore described is preferably constructed of metal, although any other suitable material, or combinations of materials, may be employed.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. An adjustable squeegee holding and counterbalance device for a silkscreen printing frame comprising in combination, a silkscreen printing frame, a printing bed, a mounting bracket member firmly affixed in flush complementary abutment to an upper corner surface of said silkscreen printing frame, hinge means connecting one side of said printing frame to said printing bed and said mounting bracket member having affixed to a first leg thereof a first set of axially aligned longitudinally disposed gudgeon members, an upwardly extending tubular support rod member, a second set of axially aligned longitudinally disposed gudgeon members complementary with said first set and connecting one end of said tubular support rod member to said first leg of said mounting bracket member, a channel shaped member having the open face thereof normally disposed upwardly to receive and support the blade end of a silkscreen squeegee, said channel member being fixedly attached midway of the longitudinal dimension thereof to the lower end of said upwardly extending tubular support rod member and the longitudinal axis of said channel shaped member being substantially parallel to the longitudinal axis of said first and second sets of axially aligned longitudinally disposed gudgeon members, an adjustable bracket member slidably mounted upon said upwardly extending tubular support rod member intermediately of the ends thereof, an adjustable counterweight member mounted upon said upwardly extending tubular support rod member substantially above the mid-point thereof, and adjustable means to position and retain said upwardly extending tubular support rod member at an outwardly disposed angle relative to said silkscreen printing frame.

2. An adjustable squeegee holding and counterbalance device for a silkscreen printing frame according to claim 1, wherein said mounting bracket member has affixed to a second leg thereof a depending leg positioned at the side thereof at a location substantially midway of the longitudinal dimension of said second leg.

3. An adjustable squeegee holding and counterbalance device for a silkscreen printing frame according to claim 1, wherein said channel shaped member has one leg affixed to said upwardly extending tubular support rod member, said one leg being of a greater vertical dimension than the vertical dimension of the other upwardly disposed leg thereof.

4. An adjustable squeegee holding and counterbalance device for a silkscreen printing frame according to claim 3, wherein said channel shaped member is provided with a disposable liquid-absorbent material to substantially cover the interior channel surface thereof.

5. An adjustable squeegee holding and counterbalance device for a silkscreen printing frame according to claim 1, wherein said adjustable bracket member has a downwardly depending flange at the inwardly disposed end thereof to retain a squeegee within said channel shaped member against accidental dislodgement therefrom.

6. An adjustable squeegee holding and counterbalance device for a silkscreen printing frame according to claim 1, wherein said adjustable counterweight member is adjustably retained in elevated position upon said upwardly extending tubular support rod member by means of a wing bolt threadably inserted through a threaded radial opening in a peripheral side of said counterweight member.

7. An adjustable squeegee holding and counterbalance device for a silkscreen printing frame according to claim 1, wherein said adjustable means comprises a bent rod member having a bent end which engagably communicates with one of a plurality of openings in said upwardly extending tubular support rod member to angularly position and retain the same at a desired angle relative to the plane of said silkscreen printing frame.

* * * * *